US009421762B1

(12) United States Patent
Abe

(10) Patent No.: US 9,421,762 B1
(45) Date of Patent: Aug. 23, 2016

(54) LIQUID EJECTING APPARATUS, DRIVE CIRCUIT, AND HEAD UNIT

(71) Applicant: Seiko Epson Corporation, Tokyo (JP)

(72) Inventor: Akira Abe, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/007,573

(22) Filed: Jan. 27, 2016

(30) Foreign Application Priority Data

Mar. 20, 2015 (JP) ..... 2015-058459

(51) Int. Cl.
*B41J 29/393* (2006.01)
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2/01; B41J 29/38; B41J 2/04501; B41J 2/0455; B41J 2002/14491; B41J 2/04548; B41J 2/355
See application file for complete search history.

(56) References Cited

U.S. PATENT DOCUMENTS 7,029,087 B2 * 4/2006 Tamura ..... B41J 2/04541 347/17
7,850,265 B2 * 12/2010 Ishizaki ..... B41J 2/04541 347/10
9,022,498 B2 * 5/2015 Otsuka ..... B41J 2/04541 347/11
2009/0206888 A1 8/2009 Kitazawa et al.

FOREIGN PATENT DOCUMENTS

JP 2009-190287 A 8/2009
JP 2010-114711 A 5/2010

* cited by examiner

*Primary Examiner* — Lamson Nguyen
(74) *Attorney, Agent, or Firm* — Harness, Dickey & Pierce, P.L.C.

(57) ABSTRACT

Provided is a liquid ejecting apparatus including an ejecting unit that ejects liquid based on a drive signal; a comparison unit that includes a first comparator and a second comparator, receives an input signal and the drive signal, and outputs a first control signal based on a signal that is obtained by offsetting one of the input signal and the drive signal by a first voltage and a second control signal based on a signal that is obtained by offsetting one of the input signal and the drive signal by a second voltage; and a pair of transistors that is configured by a first transistor which is controlled based on the first control signal and a second transistor which is controlled based on the second control signal, and outputs the drive signal, in which the first voltage and the second voltage are variable.

11 Claims, 13 Drawing Sheets

<DECODED CONTENT OF DECODER>

| | PRINTING DATA SI | T1 | | T2 | |
|---|---|---|---|---|---|
| | | Sa | Sb | Sa | Sb |
| LARGE DOT | (1, 1) | H | L | H | L |
| MEDIUM DOT | (0, 1) | H | L | L | H |
| SMALL DOT | (1, 0) | L | L | L | H |
| NO RECORD | (0, 0) | L | H | L | L |

MSB LSB

LIQUID EJECTING APPARATUS, DRIVE CIRCUIT, AND HEAD UNIT

The entire disclosure of Japanese Patent Application No. 2015-058459, filed Mar. 20, 2015 is expressly incorporated by reference herein.

BACKGROUND

1. Technical Field

The present invention relates to a liquid ejecting apparatus, a drive circuit, and a head unit.

2. Related Art

An apparatus which uses a piezoelectric element (for example, a piezo element) is known as an ink jet printer which prints an image or a document by ejecting ink. Piezoelectric elements are provided in correspondence with each of multiple nozzles in a head unit, each of the piezoelectric elements is driven in accordance with a drive signal, and thus a predetermined amount of ink (liquid) is ejected from the nozzle at a predetermined timing to form dots. The piezoelectric element is a capacitive element such as a capacitor from a viewpoint of electricity, and needs to receive a sufficient current in order to operate the piezoelectric elements of each nozzle.

For this reason, an original drive signal is amplified by an amplification circuit, is supplied to a head unit as a drive signal, and drives the piezoelectric elements. It is recommended that an amplification circuit uses a method (linear amplification, refer to JP-A-2009-190287) of current-amplifying the original drive signal in an AB class or the like. However, since power consumption increases and energy efficiency decreases in the linear amplification, a D-class amplification is also proposed in recent years (refer to JP-A-2010-114711). In short, in the D-class amplification, a pulse width modulation or a pulse density modulation of an input signal is performed, a high side transistor and a low side transistor that are coupled in series between power supply voltages are switched in accordance with the modulated signal, an output signal which is generated by the switching is filtered by a low pass filter, and thus the input signal is amplified.

However, even though energy efficiency increases in the D-class amplification method compared to a linear amplification method, power which is consumed in a low pass filter cannot be ignored, and thus there is room for improvement in terms of reducing power consumption.

SUMMARY

An advantage of some aspects of the invention is to provide a liquid ejecting apparatus, a drive circuit, and a head unit which reduce power consumption.

A liquid ejecting apparatus according to an aspect of the invention includes an ejecting unit that includes a piezoelectric element which is displaced by a drive signal that is applied, and ejects liquid in accordance with displacement of the piezoelectric element; a comparison unit that includes a first comparator and a second comparator, receives an input signal and the drive signal, and outputs a first control signal and a second control signal; and a pair of transistors that is configured by a first transistor which is controlled based on the first control signal and a second transistor which is controlled based on the second control signal, and outputs the drive signal, in which the first comparator compares a first comparison signal and a second comparison signal with each other and outputs the first control signal, in which the first comparison signal is a signal that is obtained by offsetting one of the input signal and the drive signal by a first voltage, in which the second comparator compares a third comparison signal and a fourth comparison signal with each other, and outputs the second control signal, in which the third comparison signal is a signal that is obtained by offsetting one of the input signal and the drive signal by a second voltage, and in which the first voltage and the second voltage are variable.

According to the liquid ejecting apparatus of the aspect, a low pass filter is not required, compared to a D-class amplification method, and thus power which is consumed in the low pass filter can be ignored.

In addition, the first voltage and the second voltage which are offset are variable, and thus it is possible to reduce an error of the drive signal with respect to the input signal.

In the liquid ejecting apparatus according to the aspect, a configuration may be provided in which the second comparison signal is a signal that is obtained by offsetting the other of the input signal and the drive signal by a voltage including zero volts, and the fourth comparison signal is a signal that is obtained by offsetting the other of the input signal and the drive signal by a voltage including zero volts.

In the liquid ejecting apparatus according to the aspect, a configuration may be provided in which the first voltage changes in a first section and a second section of the drive signal. According to the configuration, it is possible to reduce the error in accordance with a waveform section of the drive signal (input signal).

In addition, a configuration may be provided in which, if the amount of voltage change of the drive signal in the first section is less than the amount of voltage change of the drive signal in the second section, a first voltage in the first section is lower than a first voltage in the second section in terms of an absolute value. According to the configuration, it is possible to reduce the error in a section in which a voltage change of the drive signal (input signal) is small. In more detail, it is preferable that the first section is a section in which the amount of voltage change of the drive signal is zero.

In the liquid ejecting apparatus according to the aspect, a configuration may be provided which includes a first offset unit that decreases the input signal by the first voltage or increases the drive signal by the first voltage, and a second offset unit that increases the input signal by the second voltage or decreases the drive signal by the second voltage.

In addition, in the liquid ejecting apparatus according to the aspect, a configuration may be provided in which the first comparator sets the first control signal as a signal that turns on the first transistor, if a voltage of the drive signal is lower than a voltage that is obtained by subtracting the first voltage from a voltage of the input signal, and the second comparator sets the second control signal as a signal that turns on the second transistor, if a voltage of the drive signal is higher than or equal to a voltage that is obtained by adding the second voltage to a voltage of the input signal. According to the configuration, if a voltage of the drive signal is higher than or equal to a voltage which is obtained by subtracting the first voltage from a voltage of the input signal and lower than a voltage which is obtained by adding the second voltage to a voltage of the input signal, the first transistor and the second transistor are all turned off.

In the liquid ejecting apparatus according to the aspect, a configuration may be provided in which the input signal is a signal that is obtained by amplifying an original drive signal which is a base of the drive signal.

The liquid ejecting apparatus may be used as long as the apparatus ejects liquid, and includes a three-dimensional shaping apparatus (so-called 3D printer), a textile dyeing apparatus, or the like, in addition to a printing apparatus which will be described below.

In addition, the invention is not limited to a liquid ejecting apparatus, can be realized in various aspects, and can be conceptualized as a drive circuit which drives a capacitive load such as the piezoelectric element, a head unit of a liquid ejecting apparatus, or the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a printing apparatus according to an embodiment of the invention will be described as an example with reference to the drawings.

Figure 1:
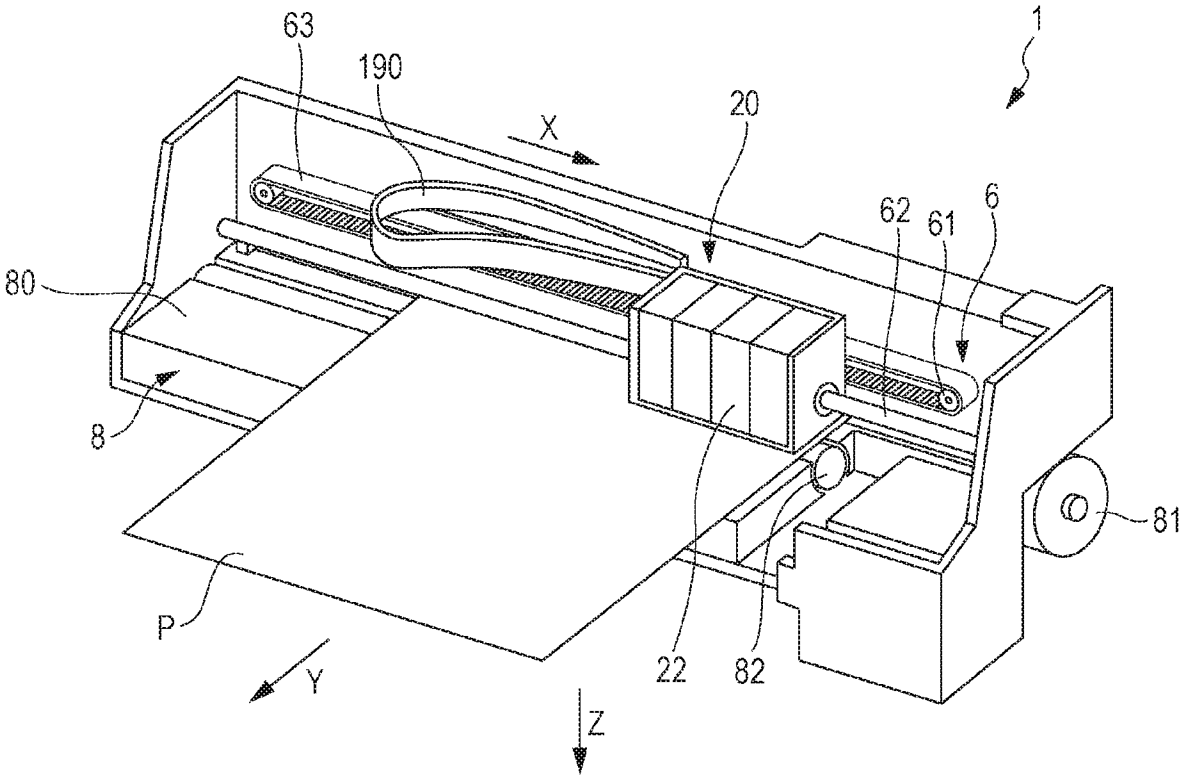
FIG. 1 is a view illustrating a schematic configuration of a printing apparatus according to an embodiment.

FIG. 1 is a perspective view illustrating a schematic configuration of a printing apparatus.

The printing apparatus 1 is a type of a liquid ejecting apparatus which forms an ink dot group on a medium P such as paper by ejecting ink as liquid, and thereby printing an image (including character, graphic, or the like).

As illustrated in FIG. 1, the printing apparatus 1 includes a moving mechanism 6 which moves (moves back and forth) a carriage 20 in a main scanning direction (X direction).

The moving mechanism 6 includes a carriage motor 61 which moves the carriage 20, a carriage guide axis 62 both of which are fixed, and a timing belt 63 which extends substantially parallel to the carriage guide axis 62 and is driven by the carriage motor 61.

The carriage 20 is supported by the carriage guide axis 62 so as to move freely back and forth, and is fixed to a part of the timing belt 63. For this reason, if the timing belt 63 travels forward and backward by the carriage motor 61, the carriage 20 is guided by the carriage guide axis 62 and moves back and forth.

A printing head 22 is mounted in the carriage 20. The printing head 22 includes multiple nozzles which respectively eject ink in the Z direction onto a portion which faces the medium P. The printing head 22 is divided into approximately four blocks for color printing. The multiple blocks respectively eject black (Bk) ink, cyan (C) ink, magenta (M) ink, and yellow (Y).

There is provided a configuration in which various control signals or the like which include a drive signal from a main substrate (omitted in FIG. 1) through a flexible flat cable 190 are supplied to the carriage 20.

The printing apparatus 1 includes the medium P and a transport mechanism 8 which transports the printing head on a platen 80. The transport mechanism 8 includes a transport motor 81 which is a drive source, and a transport roller 82 which is rotated by the transport motor 81 and transports the medium P in a sub-scanning direction (Y direction).

In the configuration, an image is formed on a surface of the medium P by ejecting ink in response to print data from the nozzles of the printing head 22 in accordance with main scanning of the carriage 20, and repeating an operation of transporting the medium P in accordance with the transport mechanism 8.

In the present embodiment, the main scanning is performed by moving the carriage 20, but may be performed by moving the medium P, and may be performed by moving both the carriage 20 and the medium P. The point is that there may be provided a configuration in which the medium P and the carriage 20 (printing head 22) move relatively.

Figure 2A:
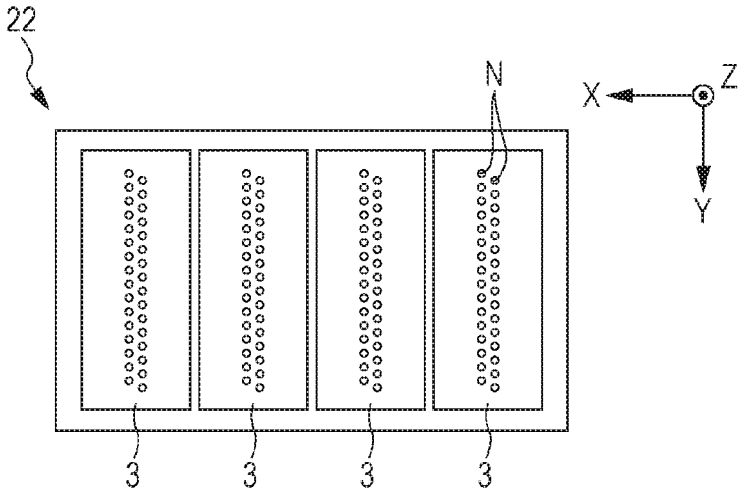
FIGS. 2A and 2B are diagrams illustrating arrangement or the like of nozzles in a head unit.

FIG. 2A is a diagram in a case in which an ejecting surface of ink in the printing head 22 is viewed from the medium P. As illustrated in FIG. 2A, the printing head 22 includes four head units 3. The four head units 3 are arranged in the X direction which is a main scanning direction in correspondence with black (Bk), cyan (C), magenta (M), and yellow (Y), respectively.

Figure 2B:
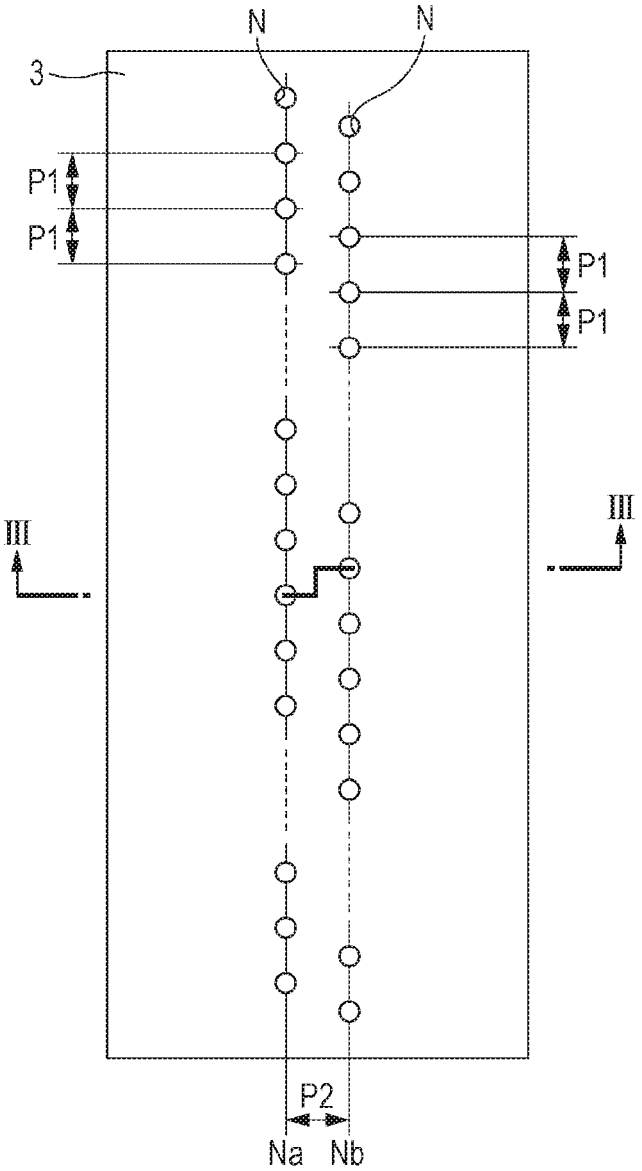

FIG. 2B is a diagram illustrating arrangement of nozzles in one head unit 3.

As illustrated in FIG. 2B, multiple nozzles are arranged in two columns in one head unit 3. For the sake of convenience, the two columns are respectively referred to as a nozzle column Na and a nozzle column Nb.

Multiple nozzles are respectively arranged in the Y direction by a pitch P1 in the nozzle columns Na and Nb. In addition, the nozzle columns Na and Nb are separated from each other by a pitch P2 in the Y direction. The nozzles N in the nozzle column Na are shifted from the nozzles N in the nozzle column Nb by a half of the pitch P1 in the Y direction.

In this way, the nozzles N are arranged so as to be shifted by a half of the pitch P1 in the two columns of the nozzle columns Na and Nb in the Y direction, and thereby it is possible to increase resolution in the Y direction substantially twice as much as a case of one column.

The number of nozzles N in one head unit 3 is referred to as m (m is an integer greater than or equal to 2) for the sake of convenience.

In the head unit 3, a flexible circuit board is connected to an actuator substrate, and a drive IC is mounted on the flexible circuit board. Next, a structure of the actuator substrate will be described.

Figure 3:
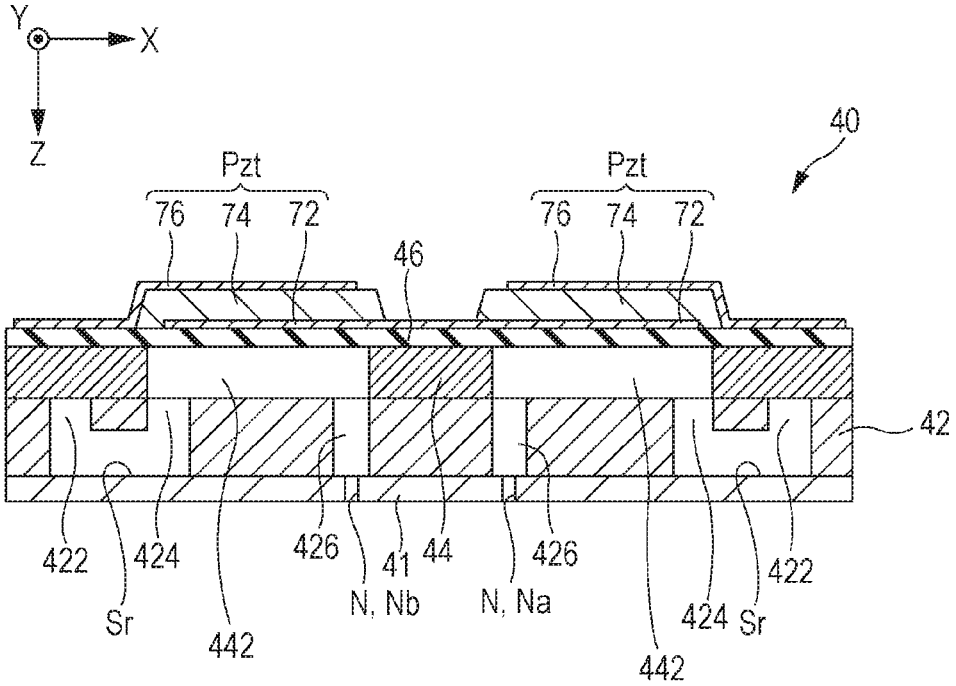
FIG. 3 is a sectional view illustrating an essential configuration of the head unit.

FIG. 3 is a sectional view illustrating a structure of the actuator substrate 40. In detail, FIG. 3 is a view illustrating a cross section taken along line III-III of FIG. 2B.

As illustrated in FIG. 3, the actuator substrate 40 has a structure in which a pressure chamber substrate 44 and a vibration plate 46 are provided on a surface on a negative side in the Z direction and a nozzle plate 41 is provided on a surface on a positive side in the Z direction, in a flow path substrate 42.

Schematically, each element of the actuator substrate 40 is a member of an approximately flat plate which is long in the Y direction, and is fixed to each other using, for example, an adhesive. In addition, the flow path substrate 42 and the pressure chamber substrate 44 are formed by, for example, a single crystal substrate of silicon.

The nozzles N are formed in the nozzle plate 41. A structure corresponding to the nozzles in the nozzle column Na is shifted from a structure corresponding to the nozzles in the nozzle column NB by a half of the pitch P1 in the Y direction, but the nozzles are formed approximately symmetrically except for that, and thus, the structure of the actuator substrate 40 will be hereinafter described by focusing on the nozzle column Na.

The flow path substrate 42 is a flat member which forms a flow path of ink, and includes an opening 422, a supply flow path 424, and a communication flow path 426. The supply flow path 424 and the communication flow path 426 are formed in each nozzle, and the opening 422 is continuously formed over the multiple nozzles and has a structure in which ink with a corresponding color is supplied. The opening 422 functions as a liquid reservoir chamber Sr, and a bottom surface of the liquid reservoir chamber Sr is configured by, for example, the nozzle plate 41. In detail, the nozzle plate 41 is fixed to the bottom surface of the flow path substrate 42 so as to close the opening 422, the supply flow path 424, and the communication flow path 426 which are in the flow path substrate 42.

The vibration plate 46 is installed on a surface on a side opposite to the flow path substrate 42, in the pressure chamber substrate 44. The vibration plate 46 is a member of an elastically vibratile flat plate, and is configured by stacking an elastic film formed of an elastic material such as a silicon oxide, and an insulating film formed of an insulating material such as a zirconium oxide. The vibration plate 46 and the flow path substrate 42 faces each other with an interval in the inner side of each opening 422 of the pressure chamber substrate 44. A space between the flow path substrate 42 and the vibration plate in the inner side of each opening 422 functions as a cavity 442 which provides a pressure to ink. Each cavity 442 communicates with the nozzle N through the communication flow path 426 of the flow path substrate 42.

A piezoelectric element Pzt is formed in each nozzle N (cavity 442) on a surface on a side opposite to the pressure chamber substrate 44 in the vibration plate 46.

The piezoelectric element Pzt includes a common drive electrode 72 formed over the multiple the piezoelectric element Pzt formed on a surface of the vibration plate 46, a piezoelectric body 74 formed on a surface of the drive electrode 72, and individual drive electrodes 76 formed in each piezoelectric element Pzt on a surface of the piezoelectric body 74. In the configuration, a region in which the piezoelectric body 74 is interposed between the drive electrode 72 and the drive electrode 76 which faces each other, functions as the piezoelectric element Pzt.

The piezoelectric body 74 is formed in a process which includes, for example, a heating process (baking). In detail, the piezoelectric body 74 is formed by baking a piezoelectric material which is applied to a surface of the vibration plate 46 on which multiple drive electrodes 72 are formed, using heating processing in a furnace, and then molding (milling by using, for example, plasma) the baked material for each piezoelectric element Pzt.

In the same manner, the piezoelectric element Pzt corresponding to the nozzle column Nb is also configured to include the drive electrode 72, the piezoelectric body 74, and the drive electrode 76.

In addition, in this example, in the piezoelectric body 74, the common drive electrode 72 is used as a lower layer and the individual drive electrodes 76 are used as an upper layer, but in contrast to this, a configuration in which the common drive electrode 72 is used as an upper layer and the individual drive electrodes 76 are used as a lower layer, may be provided.

In addition, a configuration may be provided in which the drive IC is directly mounted in the actuator substrate 40.

As will be described below, meanwhile a voltage Vout of a drive signal according to the amount of ink to be ejected is individually applied to the drive electrode 76 which is a terminal of the piezoelectric element Pzt, a retention signal of a voltage $V_{BS}$ is commonly applied to the drive electrode 72 which is the other terminal of the piezoelectric element Pzt.

For this reason, the piezoelectric element Pzt becomes displaced upwardly or downwardly in accordance with a voltage which is applied to the drive electrodes 72 and 76. In detail, if the voltage Vout of the drive signal which is applied through the drive electrode 76 decreases, the central portion of the piezoelectric element Pzt is bent upwardly with respect to both end portions, and meanwhile, if the voltage Vout increases, the central portion of the piezoelectric element Pzt is bent downwardly.

If the central portion is bent upwardly, an internal volume of the cavity 442 increases (pressure decreases), and thus ink is drawn from the liquid reservoir chamber Sr. Meanwhile, if the central portion is bent downwardly, an internal volume of the cavity 442 decreases (pressure increases), and thus ink droplet is ejected from the nozzle N in accordance with the decreased degree. In this way, if a proper drive signal is applied to the piezoelectric element Pzt, ink is ejected from the nozzle N in accordance with the displacement of the piezoelectric element Pzt. For this reason, an ejecting unit which ejects ink in accordance with at least the piezoelectric element Pzt, the cavity 442, or the nozzle N is configured.

Next, an electrical configuration of the printing apparatus 1 will be described.

Figure 4:
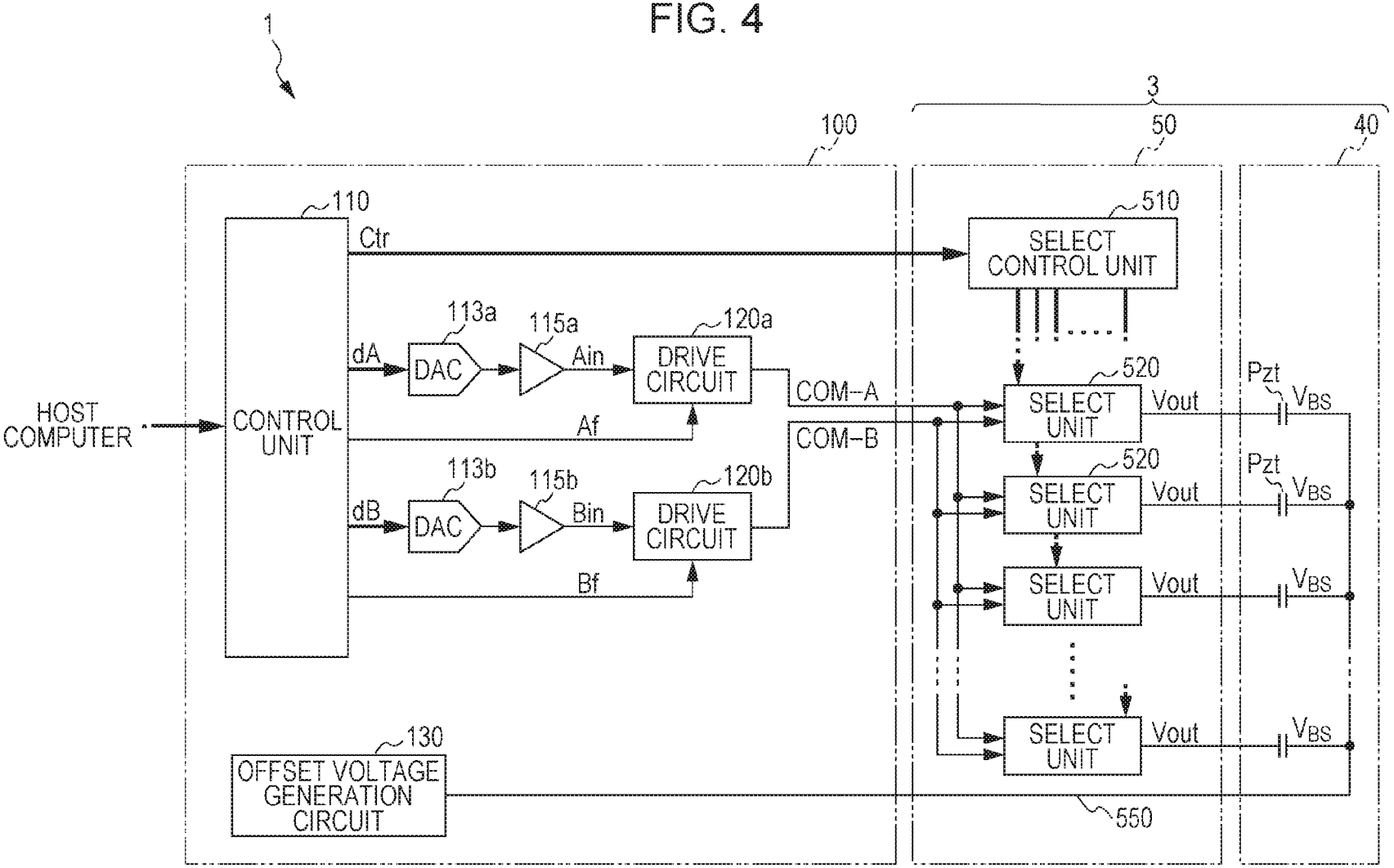
FIG. 4 is a diagram illustrating an electrical configuration of the printing apparatus.

FIG. 4 is a block diagram illustrating an electrical configuration of the printing apparatus 1.

As illustrated in FIG. 4, the printing apparatus 1 has a configuration in which the head unit 3 is coupled to a main substrate 100. The head unit 3 is largely divided into the actuator substrate 40 and a drive IC 50.

The main substrate 100 supplies a control signal Ctr or drive signals COM-A and COM-B to the drive IC 50, and supplies a retention signal of the voltage $V_{BS}$ (offset voltage) to the actuator substrate 40 through a wire 550.

In the printing apparatus 1, four head units 3 are provided, and the main substrate 100 independently controls the four head units 3. The four head units 3 are the same as each other except that the colors of ink to be ejected are different from each other, and thus, hereinafter, one head unit 3 will be representatively described for the sake of convenience.

As illustrated in FIG. 4, the main substrate 100 includes a control unit 110, D/A converters (DAC) 113*a* and 113*b*, voltage amplifiers 115*a* and 115*b*, drive circuits 120*a* and 120*b*, and a offset voltage generation circuit 130.

Among these, the control unit 110 is a type of a microcontroller having a CPU, a RAM, a ROM, and the like, and executes a predetermined program, when image data which becomes a printing target is supplied from a host computer or the like, thereby outputting various control signals or the like for controlling each unit.

Specifically, first, the control unit 110 repeatedly supplies digital data dA to the DAC 113*a* and the drive circuit 120*a*, repeatedly supplies digital data dB to the DAC 113*b* in the same manner, supplies a signal Af to the drive circuit 120*a* in accordance with an output state of the data dA, and supplies a signal Bf to the drive circuit 120*b* in accordance with an output state of the data dB.

Here, the data dA defines a waveform of the drive signal COM-A which is supplied to the head unit 3, and the data dB defines a waveform of the drive signal COM-B.

The drive signals COM-A and COM-B (signals Ain and Bin before being amplified) have respectively trapezoidal waveforms as will be described below, and thus the drive signals COM-A and COM-B are respectively divided into a flat section (first section) in which a voltage is not changed, and a change section (second section) in which a voltage rises and falls. The signal Af indicates whether the data dA defines the flat section of the drive signal COM-A (Ain) or defines the change section, and the signal Bf indicates whether the data dB defines the flat section of the drive signal COM-B (Bin) or defines the change section.

The DAC 113*a* converts the digital data dA into analog data, and supplies the data to the voltage amplifier 115*a*. In the same manner, the DAC 113*b* converts the digital data dB into analog data, and supplies the data to the voltage amplifier 115*b*.

The voltage amplifier 115*a* amplifies a signal which is converted to an analog signal by the DAC 113*a*, and supplies the signal to the drive circuit 120*a* as the signal Ain. In the same manner, the voltage amplifier 115*b* amplifies a signal which is converted to an analog signal by the DAC 113*b*, and supplies the signal to the drive circuit 120*b* as the signal Bin.

In other words, a configuration is used in which a signal (original drive signal) which is converted by the DAC 113*a* (113*b*) is amplified by the voltage amplifier 115*a* (115*b*), and is input to the drive circuit 120*a* (120*b*) as the signal Ain (Bin).

The drive circuit 120*a* will be described below in detail, but the drive circuit 120*a* is a voltage follower, and outputs the signal Ain with a high impedance as the drive signal COM-A by increasing drive capability (converting to low impedance), with respect to the piezoelectric element Pzt which is a capacitive load. In the same manner, the drive circuit 120*b* outputs the signal Bin as the drive signal COM-B with a low impedance.

The signal which is converted by the DAC 113*a* (113*b*) swings in a range of, for example, approximately 0 V to 3 V, and in contrast to this, a voltage of the drive signal COM-A (COM-B) swings in a range of, for example, approximately 0 V to 40 V. For this reason, a configuration is used in which the voltage amplifier 115*a* (115*b*) amplifies a voltage of the signal which is converted by the DAC 113*a* (113*b*), and supplies the signal to the drive circuit 120*a* (120*b*) of a voltage follower.

The drive circuits 120*a* and 120*b* just have different waveforms of signals which are input, and drive signals which are output, from each other, and have the same circuit configuration as each other.

Second, the control unit 110 supplies various control signals Ctr to the head unit 3 in synchronization with a control for the moving mechanism 6 and the transport mechanism 8. The control signals Ctr which are supplied to the head unit 3 include print data which defines the amount of ink that is ejected from the nozzle N, a clock signal which is used for transmitting the print data, a timing signal which defines a print period or the like, or the like.

The control unit 110 controls the moving mechanism 6 and the transport mechanism 8, but since a configuration thereof is known, and thus description thereof will be omitted.

The offset voltage generation circuit 130 in the main substrate 100 generates a retention signal of the voltage $V_{BS}$ and output the retention signal to the wire 550. The voltage $V_{BS}$ maintains the other terminals of the multiple piezoelectric elements Pzt in the actuator substrate 40 in a constant state.

Meanwhile, in the head unit 3, the drive IC 50 includes a select control unit 510 and select units 520 which correspond to the piezoelectric elements Pzt one to one. The select control unit 510 controls selection of each of the select units 520. In detail, the select control unit 510 stores the print data which is supplied in correspondence with a clock signal from the control unit 110 in several nozzles (piezoelectric elements Pzt) of the head unit 3 once, and instructs each select unit 520 to select the drive signals COM-A and COM-B in accordance with the print data at a start timing of a print period which is defined by a timing signal.

Each select unit 520 selects (or does not select any one) one of the drive signals COM-A and COM-B in accordance with instruction of the select control unit 510, and applies the selected signal to one terminal of the corresponding piezoelectric element Pzt as a drive signal of the voltage Vout.

As described above, one piezoelectric element Pzt is provided in each nozzle N in the actuator substrate 40. The other terminals of each piezoelectric element Pzt are coupled in common, and the voltage $V_{BS}$ from the offset voltage generation circuit 130 is applied to the other terminals through the wire 550.

In the present embodiment, ink is ejected from one nozzle N maximum twice by one dot, and thus four gradations of a large dot, a medium dot, a small dot, and no record are represented. In the present embodiment, in order to represent the four gradations, two types of the drive signals COM-A and COM-B are prepared, and each period has first half pattern and a second half pattern. Then, during one period, the drive signals COM-A and COM-B are selected (or not selected) in accordance with a gradation to be represented in the first half and a second half, and the selected signal is supplied to the piezoelectric element Pzt.

Thus, the drive signals COM-A and COM-B will be first described, and thereafter, a detailed configuration of the select control unit 510 for selecting the drive signals COM-A and COM-B, and the select unit 520 will be described.

Figure 5:
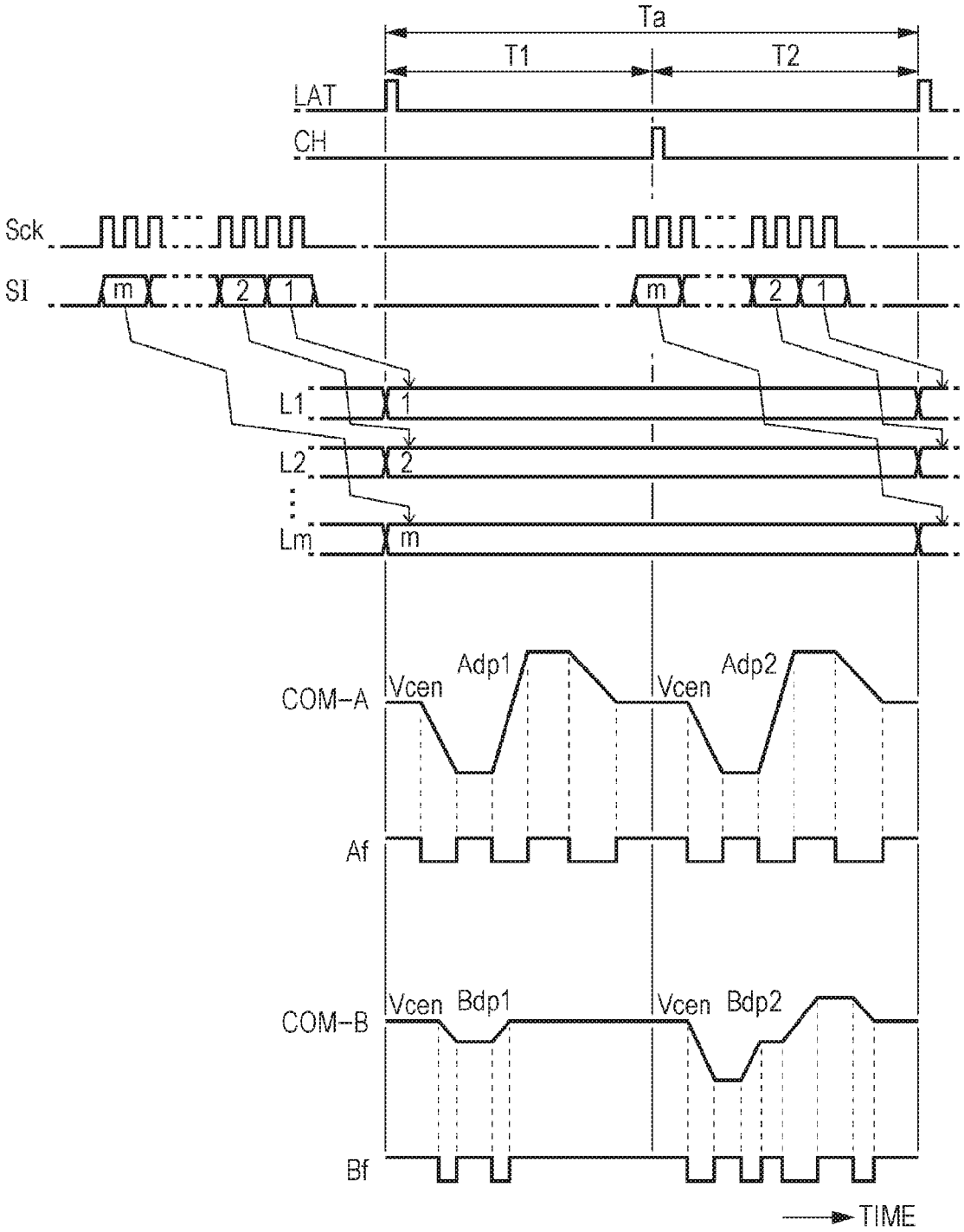
FIG. 5 is a diagram illustrating waveforms or the like of drive signals.

FIG. 5 is a diagram illustrating waveforms of drive signals COM-A and COM-B or the like.

As illustrated in FIG. 5, the drive signal COM-A is configured by a repeated waveform of a trapezoidal waveform Adp1 which is disposed during a period T1 from time when a control signal LAT is output (rises) to time when a control signal CH is output, during a print period Ta, and a trapezoidal waveform Adp2 which is disposed during a period T2 from time when the control signal CH is output and to the control signal LAT is output.

In the present embodiment, the trapezoidal waveforms Adp1 and Adp2 are approximately the same waveforms as each other, and are waveforms which respectively eject a predetermined amount of ink, in detail, an approximately medium amount of ink from the nozzles corresponding to the piezoelectric elements Pzt, if each of the trapezoidal waveforms Adp1 and Adp2 is supplied to the one terminal of the piezoelectric element Pzt.

With respect to the drive signal COM-A of the trapezoidal waveform, the signal Af is output from the control unit 110 in a waveform illustrated in figure. In detail, the signal Af goes to an H level in the flat section of a voltage of the drive signal COM-A (signal Ain), and goes to an L level in the change section.

The drive signal COM-B is configured by a repeated waveform of a trapezoidal waveform Bdp1 which is disposed during the period T1 and a trapezoidal waveform Bdp2 which is disposed during the period T2. In the present embodiment, the trapezoidal waveforms Bdp1 and Bdp2 are waveforms different form each other. Among these, the trapezoidal waveform Bdp1 is a waveform for preventing an increase of viscosity of ink by slightly vibrating the ink near the nozzle N. For this reason, even if the trapezoidal waveform Bdp1 is supplied to the one terminal of the piezoelectric element Pzt, ink is not ejected from the nozzle N corresponding to the piezoelectric element Pzt. In addition, the trapezoidal waveform Bdp2 is a waveform different from the trapezoidal waveform Adp1 (Adp2). If the trapezoidal waveform Bdp2 is supplied to the one terminal of the piezoelectric element Pzt, the trapezoidal waveform Bdp2 becomes a waveform which ejects the amount of ink less than the predetermined amount from the nozzle N corresponding to the piezoelectric element Pzt.

The signal Bf goes to an H level in the flat section of a voltage of the drive signal COM-B (signal Bin), and goes to an L level in the change section.

The control unit 110 repeatedly reads a discrete value of the trapezoidal waveform stored in a ROM in accordance with, for example, continuous addresses, and thereby outputting the data dA (dB). During the output, the control unit 110 sets the signal Af (Bf) to an H level while the read address of the trapezoidal waveform is between a start point of the flat section and an end point of the flat section (start point of the change section), and sets the signal Af (Bf) to an L level while the read address of the trapezoidal waveform is between a start point of the change section and an end point of the change section (start point of the flat section)

Voltages at a start timing of the trapezoidal waveforms Adp1, Adp2, Bdp1, and Bdp2, and voltages at an end timing of the trapezoidal waveforms Adp1, Adp2, Bdp1, and Bdp2 are all common at a voltage Vcen. That is, the trapezoidal waveforms Adp1, Adp2, Bdp1, and Bdp2 are waveforms which respectively start at the voltage Vcen and ends at the voltage Vcen.

In addition, a maximum voltage value of the trapezoidal waveform Adp1 is approximately 40 volts.

Figures 6, 7:
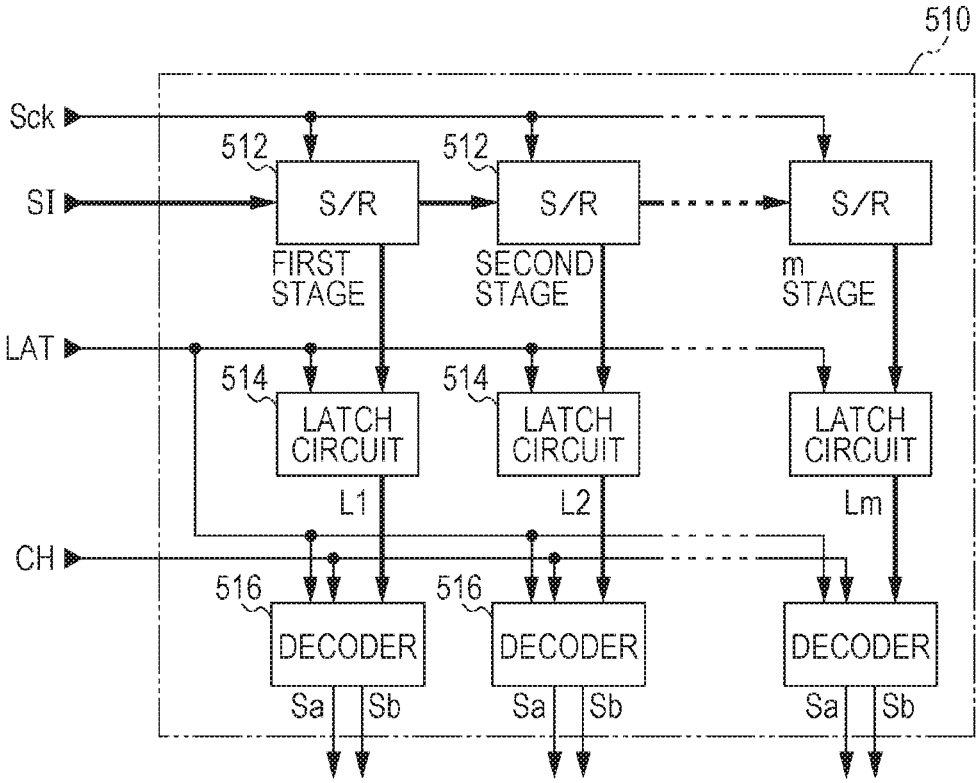
FIG. 6 is a diagram illustrating a configuration of a select control unit.
FIG. 7 is a diagram illustrating decoded content of a decoder.

FIG. 6 is a diagram illustrating a configuration of the select control unit 510 of FIG. 4.

As illustrated in FIG. 6, a clock signal Sck, the print data SI, and the control signals LAT and CH are supplied to the select control unit 510. Multiple sets of a shift register (S/R) 512, a latch circuit 514, and a decoder 516 are provided in correspondence with each of the piezoelectric elements Pzt (nozzles N) in the select control unit 510.

The print data SI is data which defines dots to be formed by all the nozzles N in the head unit 3 which is focused during the print period Ta. In the present embodiment, in order to represent the four gradations of no record, a small dot, a medium dot, and a large dot, the print data for one nozzle is configured by two bits of a most significant bit (MSB) and a least significant bit (LSB).

The print data SI is supplied in accordance with transport of the medium P for each nozzle N (piezoelectric element Pzt) in synchronization with the clock signal Sck. The shift register 512 has a configuration in which the print data SI of two bits is retained once in correspondence with the nozzle N.

In detail, shift registers 512 of total m stages corresponding to each of m piezoelectric elements Pzt (nozzles) are coupled in cascade, and the print data SI which is supplied to the shift register 512 of a first stage located at a left end of FIG. 6 is sequentially transmitted to the rear stage (downward side) in accordance with the clock signal Sck.

In FIG. 6, in order to separate the shift registers 512, the shift register 512 are sequentially referred to as a first stage, a second stage, . . . , an mth stage from an upper side to which the print data SI is supplied.

The latch circuit 514 latches the print data SI retained in the shift register 512 at a rising edge of the control signal LAT.

The decoder 516 decodes the print data SI of two bits which are latched in the latch circuit 514, outputs select signals Sa and Sb for each of periods T1 and T2 which are defined by the control signal LAT and the control signal CH, and defines select of the select unit 520.

FIG. 7 is a diagram illustrating decoded content of the decoder 516.

In FIG. 7, the print data SI of two bits which are latched is referred to as an MSB and an LSB. In the decoder 516, if the latched print data SI is (0,1), it means that logic levels of the select signals Sa and Sb are respectively output as levels of H and L during the period T1, and levels of L and H during the period T2.

The logic levels of the select signals Sa and Sb are level-shifted by a level shifter (not illustrated) to a higher amplitude logic than the logic levels of the clock signal Sck, the print data SI, and the control signals LAT and CH.

Figure 8:
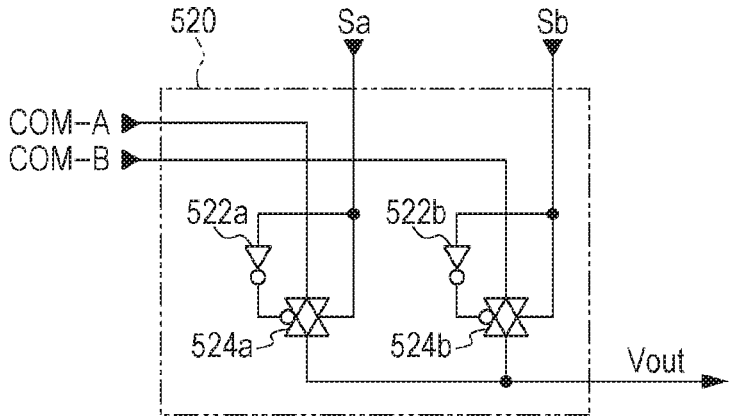
FIG. 8 is a diagram illustrating a configuration of a select unit.

FIG. 8 is a diagram illustrating a configuration of the select unit 520 of FIG. 4.

As illustrated in FIG. 8, the select unit 520 includes inverters (NOT circuit) 522*a* and 522*b*, and transfer gates 524*a* and 524*b*.

The select signal Sa from the decoder 516 is supplied to a positive control terminal to which a round mark is not attached in the transfer gate 524*a*, is logically inverted by the inverter 522*a*, and is supplied to a negative control terminal to which a round mark is attached in the transfer gate 524*a*. In the same manner, the select signal Sb is supplied to a positive control terminal of the transfer gate 524*b*, is logically inverted by the inverter 522*b*, and is supplied to a negative control terminal of the transfer gate 524*b*.

The drive signal COM-A is supplied to an input terminal of the transfer gate 524*a*, and the drive signal COM-B is supplied to an input terminal of the transfer gate 524*b*. The output terminals of the transfer gates 524*a* and 524*b* are coupled to each other, and are coupled to one terminal of the corresponding piezoelectric element Pzt.

If the select signal Sa goes to an H level, the input terminal and the output terminal of the transfer gate 524*a* are electrically coupled (ON) to each other. If the select signal Sa goes to an L level, the input terminal and the output terminal of the transfer gate 524*a* are electrically decoupled (OFF) from each other. In the same manner, the input terminal and the output terminal of the transfer gate 524*b* are also electrically coupled to each other or decoupled from each other in accordance with the select signal Sb.

As illustrated in FIG. 5, the print data SI is supplied to each nozzle in synchronization with the clock signal Sck, and is sequentially transmitted to the shift registers 512 corresponding to the nozzles. Thus, if supply of the clock signal Sck is stopped, the print data SI corresponding to each nozzle is retained in each of the shift registers 512.

If the control signal LAT rises, each of the latch circuits 514 latches all of the print data SI retained in the shift registers 512. In FIG. 5, the number in L1, L2, . . . , Lm indicate the print data SI which is latched by the latch circuits 514 corresponding to the shift registers 512 of the first stage, the second stage, . . . , the mth stage.

The decoder 516 outputs the logic levels of the select signals Sa and Sb in the content illustrated in FIG. 7 in accordance with the size of the dots which are defined by the latched print data SI during the periods T1 and T2.

That is, first, the decoder 516 sets the select signals Sa and Sb to levels of H and L during the period T1 and levels of H and L even during the period T2, if the print data SI is (1,1) and the size of the large dot is defined. Second, the decoder 516 sets the select signals Sa and Sb to levels of H and L during the period T1 and levels of L and H during the period T2, if the print data SI is (0,1) and the size of the medium dot is defined. Third, the decoder 516 sets the select signals Sa and Sb to levels of L and L during the period T1 and levels of L and H during the period T2, if the print data SI is (1,0) and the size of the small dot is defined. Fourth, the decoder 516 sets the select signals Sa and Sb to levels of L and H during the period T1 and levels of L and L during the period T2, if the print data SI is (0,0) and no recode is defined.

Figure 9:
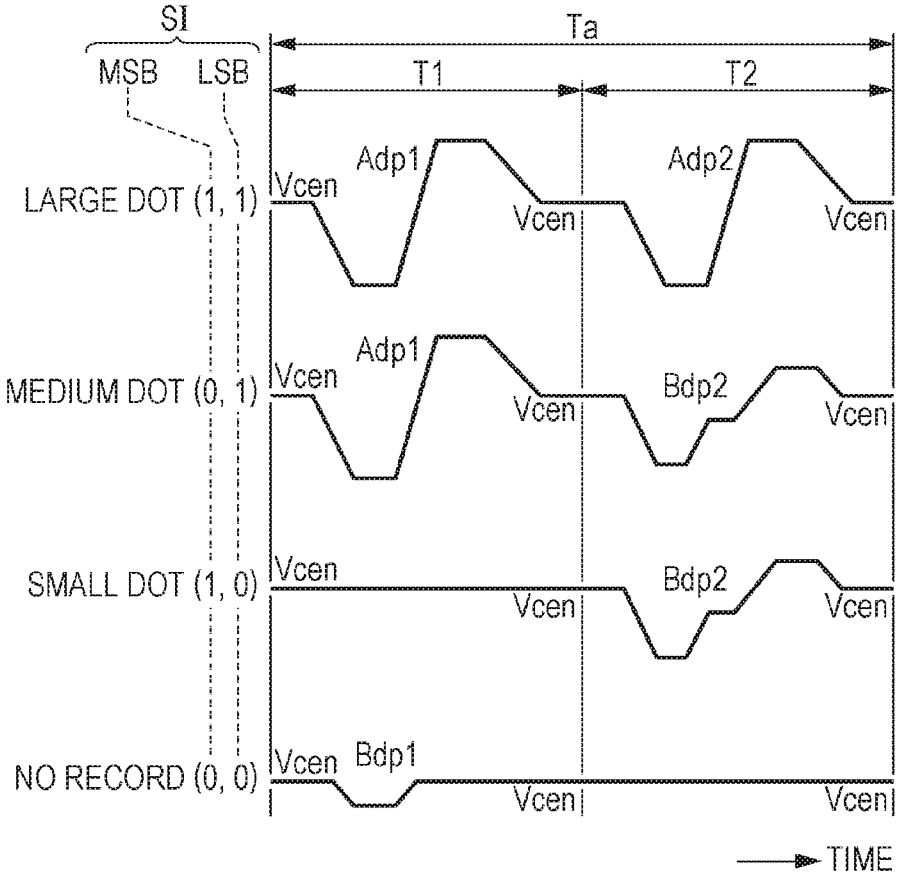
FIG. 9 is a diagram illustrating drive signals which are selected by the select unit and are supplied to a piezoelectric element.

FIG. 9 is a diagram illustrating waveforms of the drive signals which are selected in accordance with the print data SI and are supplied to one terminal of the piezoelectric element Pzt.

When the print data SI is (1,1), the select signals Sa and Sb become H and L levels during the period T1, and thus the transfer gate 524*a* is turned on, and the transfer gate 524*b* is turned off. For this reason, the trapezoidal waveform Adp1 of the drive signal COM-A is selected during the period T1. Since the select signals Sa and Sb go to H and L levels even during the period T2, the select unit 520 selects the trapezoidal waveform Adp2 of the drive signal COM-A.

In this way, if the trapezoidal waveform Adp1 is selected during the period T1, the trapezoidal waveform Adp2 is selected during the period T2, and the selected waveforms are supplied to one terminal of the piezoelectric element Pzt as drive signals, ink of an approximately medium amount is ejected twice from the nozzle N corresponding to the piezoelectric element Pzt. For this reason, each ink is landed on and combined with the medium P, and as a result, a large dot is formed as defined by the print data SI.

When the print data SI is (0,1), the select signals Sa and Sb become H and L levels during the period T1, and thus the transfer gate 524*a* is turned on, and the transfer gate 524*b* is turned off. For this reason, the trapezoidal waveform Adp1 of the drive signal COM-A is selected during the period T1. Next, since the select signals Sa and Sb go to L and H levels during the period T2, the trapezoidal waveform Bdp2 of the drive signal COM-B is selected.

Hence, ink of an approximately medium amount and an approximately small amount is ejected twice from the nozzle N. For this reason, each ink is landed on and combined with the medium P, and as a result, a medium dot is formed as defined by the print data SI.

When the print data SI is (1,0), the select signals Sa and Sb become all L levels during the period T1, and thus the transfer gates 524*a* and 524*b* are turned off. For this reason, the trapezoidal waveforms Adp1 and Bdp1 are not selected during the period T1. If the transfer gates 524*a* and 524*b* are all turned off, a path from a connection point of the output terminals of the transfer gates 524*a* and 524*b* to one terminal of the piezoelectric element Pzt becomes a high impedance state in which the path is not electrically coupled to any portion. However, both terminals of the piezoelectric element Pzt retain a voltage ($Vcen-V_{Bs}$) shortly before the transfer gates are turned off, by capacitance included in the piezoelectric element Pzt itself.

Next, since the select signals Sa and Sb go to L and H levels during the period T2, the trapezoidal waveform Bdp2 of the drive signal COM-B is selected. For this reason, ink of an approximately small amount is ejected from the nozzle N only during the period T2, and thus small dot is formed on the medium P as defined by the print data SI.

When the print data SI is (0,0), the select signals Sa and Sb become L and H levels during the period T1, and thus the transfer gates 524*a* is turned off and the transfer gate 524*b* is turned on. For this reason, the trapezoidal waveforms Bdp1 of the drive signal COM-B is selected during the period T1. Next, since all of the select signals Sa and Sb go to L levels during the period T2, the trapezoidal waveforms Adp2 and Bdp2 are all not selected.

For this reason, ink near the nozzle N just slightly vibrates during the period T1, and the ink is not ejected, and thus, as a result, dots are not formed, that is, no record is made as defined by the print data SI.

In this way, the select unit 520 selects (or does not select) the drive signals COM-A and COM-B in accordance with instruction of the select control unit 510, and applies the selected signal to one terminal of the piezoelectric element Pzt. For this reason, each of the piezoelectric elements Pzt is driven in accordance with the size of the dot which is defined by the print data SI.

The drive signals COM-A and COM-B illustrated in FIG. 5 are just an example. Actually, combinations of various waveforms which are prepared in advance are used in accordance with properties, transport speed, or the like of the medium P.

In addition, here, an example in which the piezoelectric element Pzt is bent upwardly in accordance with a decreases of a voltage is used, but if a voltage which is applied to the drive electrodes 72 and 76 is inverted, the piezoelectric element Pzt is bent downwardly in accordance with a decrease of the voltage. For this reason, in a configuration in which the piezoelectric element Pzt is bent downwardly in accordance with a decrease of a voltage, the drive signals COM-A and COM-B illustrated in the figure have waveforms which are inverted by using the voltage Vcen as a reference.

Next, with regard to the drive circuits 120*a* and 120*b* in the main substrate 100, an example in which the drive circuit 120*a* that outputs the drive signal COM-A is used will be described.

Figure 10:
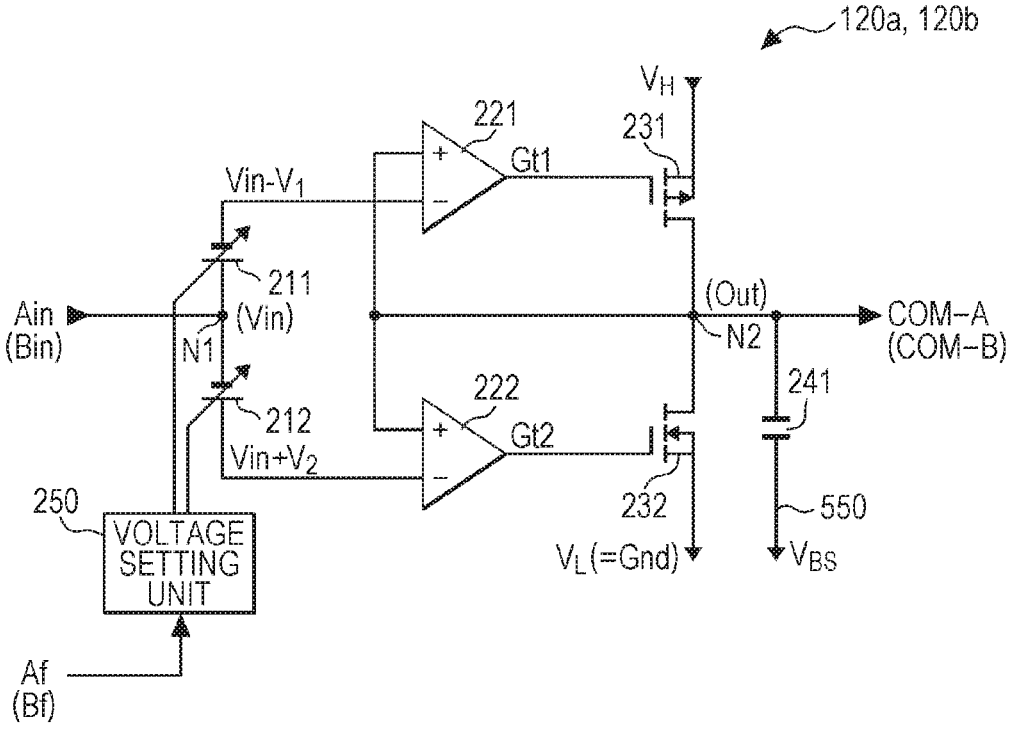
FIG. 10 is a diagram illustrating a configuration of a drive circuit.

FIG. 10 is a circuit diagram illustrating a configuration of the drive circuit 120*a*.

As illustrated in FIG. 10, the drive circuit 120*a* includes reference power supplies 211 and 212, comparators 221 and 222, transistors 231 and 232, a capacitor 241, and a voltage setting unit 250.

Among these, the reference power supply (first offset unit) 211 outputs a voltage $V_1$ which is changed in accordance with instruction of the voltage setting unit 250 between a positive terminal and a negative terminal thereof. Here, the positive terminal of the reference power supply 211 is coupled to a terminal N1 to which a voltage Vin of the signal Ain is supplied from a voltage amplifier 115*a* (refer to FIG. 4), and the negative terminal of the reference power supply 211 is coupled to a negative input terminal (−) of the comparator 221. For this reason, a voltage (Vin−$V_1$) which is obtained by subtracting the voltage $V_1$ from the voltage Vin that is an input signal is applied to the negative input terminal (−) of the comparator 221 as a first offset signal. The positive input terminal (+) of the comparator 221 is coupled to the terminal N2 from which the drive signal COM-A is output.

The comparator (first comparator) 221 outputs the signal Gt1 according to the comparison result of a voltage applied to the positive input terminal (+) and a voltage applied to the negative input terminal (−), as a first control signal. In detail, the comparator 221 outputs the signal Gt1 as an H level, if a voltage Out (voltage of the drive signal COM-A) applied to the positive input terminal (+) is higher than or equal to the voltage (Vin−$V_1$) applied to the negative input terminal (+), and outputs the signal Gt1 as an L level, if the voltage Out is lower than the voltage (Vin−$V_1$).

Here, in the comparator 221, if a signal of the voltage (Vin−$V_1$) which is applied to the negative input terminal (−) is set as a first comparison signal, a signal of the voltage Out which is applied to the positive input terminal (+) becomes a second comparison signal in which an offset voltage becomes zero volts.

Meanwhile, the reference power supply (second offset unit) 212 outputs a voltage $V_2$ which is changed in accordance with instruction of the voltage setting unit 250 between a positive terminal and a negative terminal thereof. Here, the negative terminal of the reference power supply 212 is coupled to the terminal N1, and the positive terminal of the reference power supply 212 is coupled to a negative input terminal (−) of the comparator 222. For this reason, a voltage (Vin+$V_2$) which is obtained by adding the voltage $V_2$ to the voltage Vin is applied to the negative input terminal (−) of the comparator 222 as a second offset signal. The positive input terminal (+) of the comparator (second comparator) 222 is coupled to the terminal N2.

The comparator 222 outputs a signal Gt2 according to comparison result of a voltage applied to the positive input terminal (+) and a voltage applied to the negative input terminal (−), as a second control signal. In detail, the comparator 222 outputs the signal Gt2 ad an H level, if the voltage Out applied to the positive input terminal (+) is higher than or equal to the voltage (Vin+$V_2$) applied to the negative input terminal (−), and outputs the signal Gt2 with an L level, if the voltage Out is lower than the voltage (Vin+$V_2$).

Here, in the comparator 222, if a signal of the voltage (Vin+$V_2$) applied to the negative input terminal (−) is set as a third comparison signal, a signal of the voltage Out applied to the positive input terminal (+) becomes a fourth comparison signal in which an offset voltage becomes zero volts.

A comparison unit is configured by the comparators 221 and 222.

The voltage setting unit 250 instructs the reference power supplies 211 and 212 to switch output voltages in accordance with the signal Af. In detail, the voltage setting unit 250 instructs the reference power supply 211 to relatively reduce (decrease) more a voltage $V_1$ in a case in which the signal Af is in an H level (case in which the signal Ain is in a flat section of a voltage) than a voltage $V_1$ in a case in which the signal Af is in an L level (case in which the signal Bin is in a change section of a voltage). In the same manner, the voltage setting unit 250 instructs the reference power supply 212 to relatively reduce more the voltage $V_2$ in a case in which the signal Af is in an H level than a voltage $V_2$ in a case in which the signal Af is in an L level.

In a pair of transistors 231 and 232, the transistor (first transistor) 231 is, for example, a P-channel field effect transistor, a high side voltage $V_H$ of the power supply is applied to a source terminal thereof, a drain terminal thereof is coupled to a terminal N2, and the signal Gt1 which is output from the comparator 221 is supplied to a gate terminal thereof. The transistor (second transistor) 232 is, for example, a N-channel field effect transistor, a low side voltage $V_L$ is applied to a source terminal thereof, a drain terminal thereof is coupled to the terminal N2, and the signal Gt2 which is output from the comparator 222 is supplied to a gate terminal thereof.

That is, a configuration is used in which the transistors 231 and 232 are electrically coupled in series between the power supplies, and the drive signal COM-A is output from the terminal N2 which is a connection point thereof.

The ground Gnd which is 0 volts is used for the low side voltage $V_L$. Here, if the voltage $V_H$ and Gnd are used as the power supplies, an H level of the signals Gt1 and Gt2 becomes the voltage $V_H$, and an L level becomes the ground Gnd.

One terminal of the capacitor 241 is coupled to the terminal N2, and the other terminal of the capacitor 241 is coupled to a constant potential, for example, a wire 550 of a voltage $V_{BS}$.

The signal Ain (voltage Vin) before impedance conversion of the drive signal COM-A is a trapezoidal waveform, and thus a change of the voltage Vin becomes four patterns as follows. That is, the four patterns include:

a change from rise to flat (first pattern),
a change from flat to fall (second pattern),
a change from fall to flat (third pattern),
a change from flat to rise (fourth pattern).

In the four patterns, it does not mean that the voltage Vin changes necessarily in that sequence.

Figure 11A:
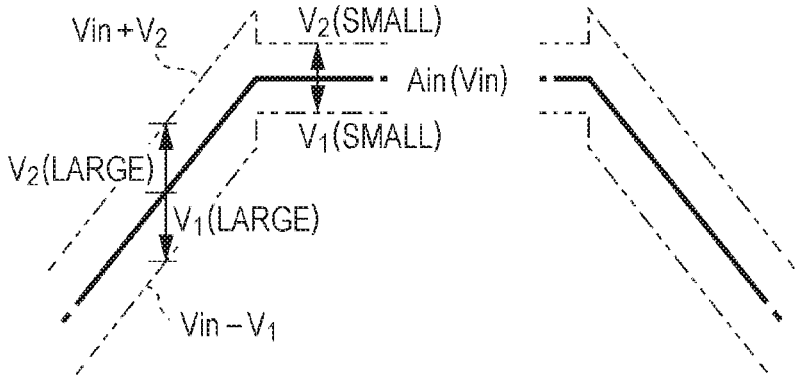
FIGS. 11A and 11B are diagrams illustrating an operation of the drive circuit.
Figure 11B:
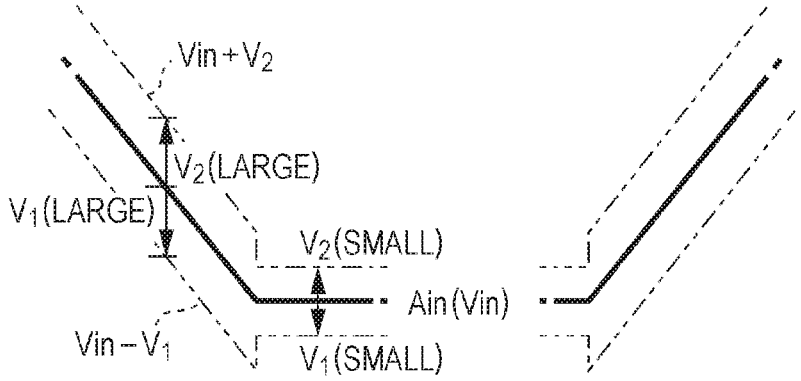

FIGS. 11A and 11B are diagrams illustrating a change of the voltage (Vin−$V_1$) applied to the negative input terminal (−) of the comparator 221 and the voltage (Vin+$V_2$) applied to the negative input terminal (−) of the comparator 222, with respect to a change of the voltage Vin of the signal Ain.

In detail, FIGS. 11A and 11B are diagrams illustrating a change of respective cases including a case in which the left column of (a) is the first pattern, a case in which the right column of (a) is the second pattern, a case in which the left column of (b) is the third pattern, and a case in which the right column of (b) is the fourth pattern, in the voltages (Vin−$V_1$) and (Vin+$V_2$) with respect to the voltage Vin.

If the voltage Vin changes to rise or fall, the voltages (Vin−$V_1$) and (Vin+$V_2$) also change respectively in accordance with the voltage Vin. Meanwhile, when the voltage Vin is flat, the voltage $V_1$ and $V_2$ are switched to values smaller than the values being generated when the voltage Vin changes until then in terms of an absolute value, and thus a width of height (dead bandwidth) of the voltages (Vin−$V_1$) and (Vin+$V_2$) becomes narrower.

In the configuration of the drive circuit 120*a*, if the voltage Out of the terminal N2 is lower than the voltage (Vin−$V_1$), the signal Gt1 goes to an L level and the transistor 231 is turned on, and thus the voltage Out is controlled so as to increase. Meanwhile, if the voltage Out of the terminal N2 is higher than or equal to the voltage (Vin+$V_2$), the signal Gt2 goes to an H level and the transistor 232 is turned on, and thus the voltage Out is controlled so as to decrease.

Figure 12:
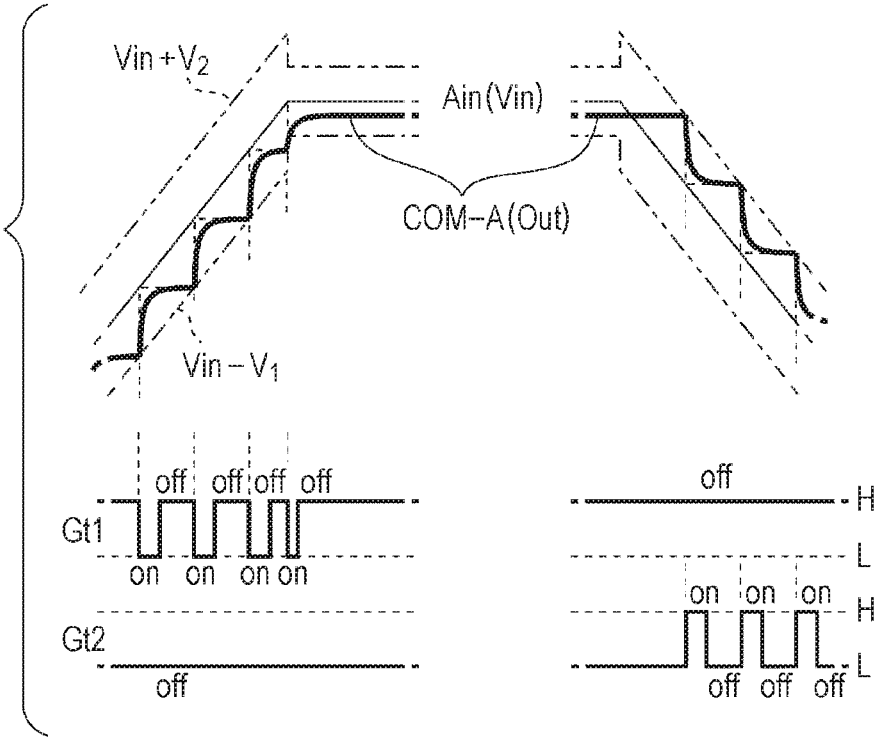
FIG. 12 is a diagram illustrating an operation of the drive circuit.
Figure 13:
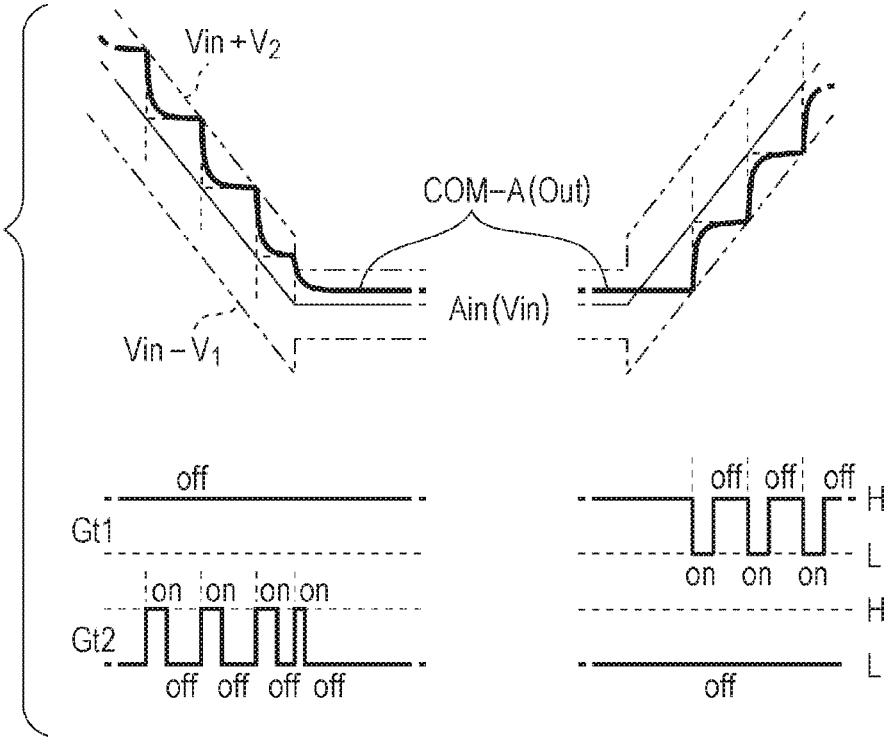
FIG. 13 is a diagram illustrating an operation of the drive circuit.

FIG. 12 and FIG. 13 are diagrams illustrating a change of the drive signal COM-A, that is, the voltage Out with respect to a change of the voltage Vin of the signal Ain.

The left column of FIG. 12 is a diagram illustrating a waveform of the voltage Out when the voltage Vin changes in the first pattern.

In a case in which the voltage Vin rises, when the voltage Out is lower than the voltage (Vin−$V_1$), the signal Gt1 goes to an L level, the transistor 231 is turned on, and thus the voltage Out rises. However, the voltage Out immediately rises to a voltage higher than or equal to the voltage (Vin−$V_1$), and thus the signal Gt1 goes to an H level, and the transistor 231 is turned off. When the voltage Vin rises, such an operation is repeated, and thus the voltage Out ideally changes in a stepwise shape as illustrated by a dashed line in the figure. However, when viewed from the terminal N2 toward an output side, a type of integral circuit is formed by resistance or impedance components through which the drive signal COM-A is transmitted, the piezoelectric element Pzt which is a load, and the capacitor 241, and thus an actual waveform of the voltage Out becomes gentle with respect to the stepwise waveform.

When the voltage Vin changes from rise to flat, the voltage (Vin−$V_1$) becomes flat in a state in which the dead bandwidth from the voltage (Vin−$V_1$) to the voltage (Vin+$V_2$) is narrowed. When the voltage Vin rises, the voltage Out is retained in accordance with the piezoelectric element Pzt that is a load, or the capacitor 241, as a value when the transistor 231 is finally turned off from a turn-on state.

The right column of FIG. 12 is a diagram illustrating a waveform of the voltage Out when the voltage Vin changes in the second pattern.

If the voltage Vin changes from flat to fall, the voltage (Vin+$V_2$) also fall in accordance with the voltage Vin. With respect to the fall of the voltage Vin, if the voltage Out which is retained flat goes to a voltage higher than or equal to the voltage (Vin+$V_2$), the transistor 232 is turned on, and thus the voltage Out decreases. However, the voltage Out immediately becomes lower than the voltage (Vin+$V_2$), and thus the transistor 232 is turned off. When the voltage Vin falls, such an operation is repeated, and thus the voltage Out ideally changes in a stepwise shape as illustrated by a dashed line in the figure, but an actual waveform of the voltage Out becomes gentle by the integral circuit.

The left column of FIG. 13 is a diagram illustrating a waveform of the voltage Out when the voltage Vin changes in the third pattern. When the voltage Vin changes from fall to flat, the voltage (Vin−$V_1$) becomes flat in a state in which the dead bandwidth from the voltage (Vin−$V_1$) to the voltage (Vin+$V_2$) is narrowed. When the voltage Vin falls, the voltage Out is retained as a value when the transistor 232 is finally turned off from a turn-on state.

The right column of FIG. 13 is a diagram illustrating a waveform of the voltage Out when the voltage Vin changes in the fourth pattern. When the voltage Vin changes from flat to rise, the voltage (Vin−$V_1$) also rises in accordance with the voltage Vin. With respect to the rise of the voltage Vin, the voltage Out which retained flat becomes lower than the rising voltage (Vin−$V_1$). The subsequent operation is the same as the operation when the voltage Vin rises in the first pattern.

Here, the drive circuit 120*a* is described, but the drive circuit 120*b* has the same configuration and operation as the drive circuit 120*a*.

According to the drive circuits 120*a* and 120*b* of the present embodiment, a circuit which oscillates a triangular waveform or the like when an input signal is modulated, or a low pass filter for demodulation is not required, compared to a D-class amplification method, and thus it is possible to simplify a circuit configuration and to reduce power consumption by that amount.

In addition, if a voltage of the input signal is flat, the transistors 231 and 232 are all maintained turned off, and thus a problem in which power is wastefully consumed by switching is not also created.

Hence, according to the drive circuits 120*a* and 120*b*, it is possible to simplify a circuit configuration and to more reduce power consumption.

Figure 14A:
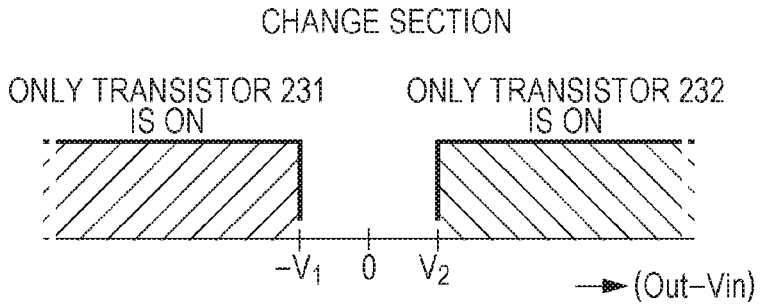
FIGS. 14A and 14B are diagrams illustrating an operation of a transistor with regard to a relationship between an input signal and an output signal.
Figure 14B:
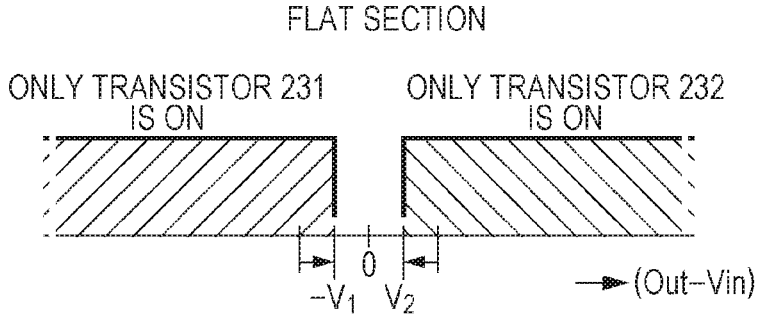

FIGS. 14A and 14B are diagrams illustrating a region in which transistors 231 and 232 are turned on with regard to a change of a voltage (Out−Vin).

As illustrated in FIG. 14A, when the voltage Out of the drive signal COM-A follows the voltage Vin, if the voltage (Out−Vin) is lower than −$V_1$, only the transistor 231 is turned on, and if the voltage (Out−Vin) is higher than or equal to $V_2$, only the transistor 232 is turned on. Meanwhile, if the voltage (Out−Vin) is higher than or equal to −$V_1$ and lower than $V_2$, the transistors 231 and 232 are all turned off. That is, in the drive circuit 120*a*, a region exists in which the voltage Out does not change, that is, the aforementioned dead bandwidth exists. The dead bandwidth is a region in which the voltage (Out−Vin) is higher than or equal to −$V_1$ and lower than $V_2$, and in other words, the dead bandwidth is a region from the voltage (Vin−$V_1$) to the voltage (Vin+$V_2$).

In the present embodiment, due to the dead bandwidth, the voltage Out has an error of maximum $V_1$ in a negative direction, and an error of maximum $V_2$ in a positive direction, with respect to the voltage Vin.

In the change section of the voltage Vin, the voltage (Out−Vin) immediately becomes lower than −$V_1$ or becomes higher than or equal to $V_2$. That is, in the change section, the voltage Vout immediately becomes lower than the voltage (Vin−$V_1$) or the voltage Vout becomes higher than or equal to (Vin+$V_2$). For this reason, one of the transistors 231 and 232 is turned on, the voltage Vout is controlled so as to follow the voltage Vin, and thus the error does not become a problem.

However, in the flat section in which the voltage Vin does not change, if the voltage Vout converges to a dead bandwidth which is higher than or equal to the voltage (Vin−$V_1$) and lower than the voltage (Vin+$V_2$), the voltage Vout is retained in a constant value, the voltage (Vin−$V_1$) and the voltage (Vin+$V_2$) which define the dead bandwidth are also not changed, and thus the error is temporally continued.

Hence, in the present embodiment, when in the flat section, the reference power supplies 211 and 212 respectively changes small the voltages $V_1$ and $V_2$ in accordance with instruction of the voltage setting unit 250 even during the change section (in terms of an absolute value).

As a result, as illustrated in FIGS. 11A and 11B, the dead bandwidth is narrowed in the flat section, and as illustrated in FIG. 12 and FIG. 13, the error can be reduced. Hence, in the present embodiment, it is possible to increase reproducibility of an ejection waveform and to increase ejection accuracy of ink.

Figure 16:
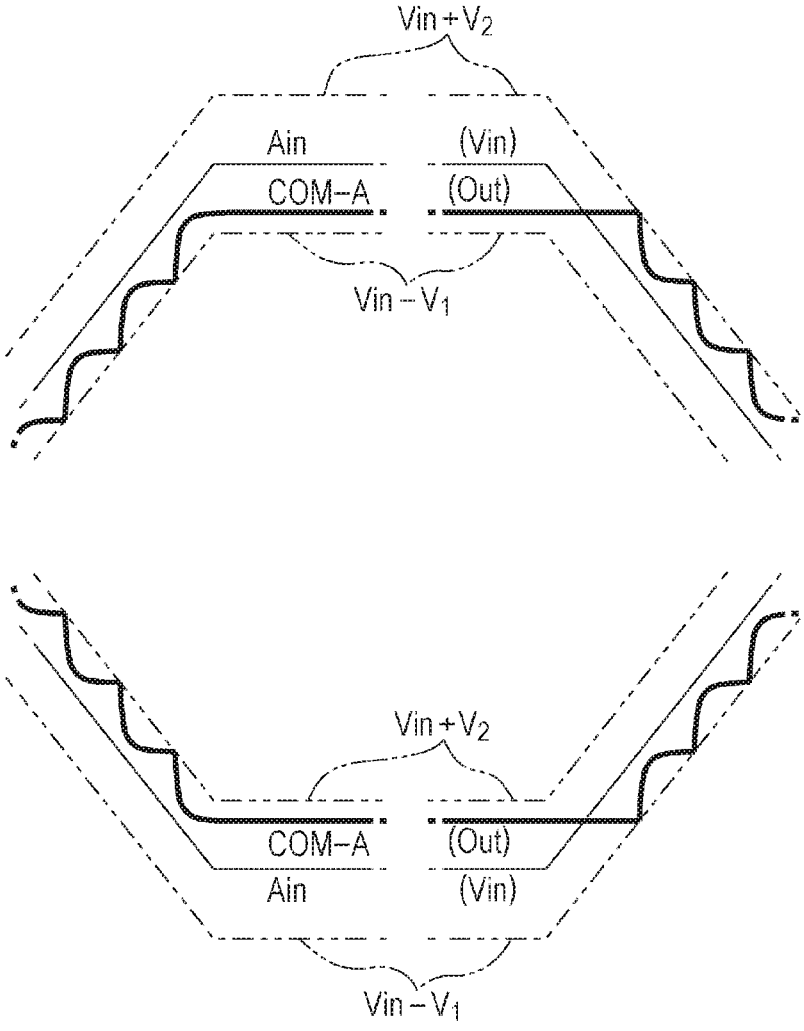
FIG. 16 is a diagram illustrating an operation of a drive circuit according to a comparative example.

Here, As illustrated in FIG. 16, in a configuration in which the voltages $V_1$ and $V_2$ are set to a constant value without switching in the flat section and the change section of the voltage Vin, the voltage Vout has a constant value over a wide dead bandwidth in the flat section, and thus the error becomes great.

FIG. 16 is a diagram illustrating an operation of the drive circuit according to a comparative example.

In the embodiment, the transistor 231 is set to a P-channel type, and the transistor 232 is set to an N-channel type, but the transistors 231 and 232 may be set to P-channel type or N-channel type.

In addition, the transistors 231 and 232 are described as switching elements which are turned on or off, but the invention is not limited to this. For example, a configuration may be provided in which a drain current (resistance between source and drain) is changed in accordance with a voltage between a gate and a source. That is, a configuration may be provided in which the transistor 231 (232) is controlled by the signal Gt1 (Gt2).

In the embodiment, the voltage Vin is offset by the reference power supply 211 by the voltage $V_1$, and is offset by the reference power supply 212 by the voltage $V_2$, but since two voltages which are obtained by offsetting the voltage Vin (or the voltage Out as illustrated below) in vertical direction may be able to obtain, a configuration for the offset is not limited to elements such as a power supply (battery). For example, multiple combinations of the elements such as diodes or resistors may be used as follows.

Figure 15:
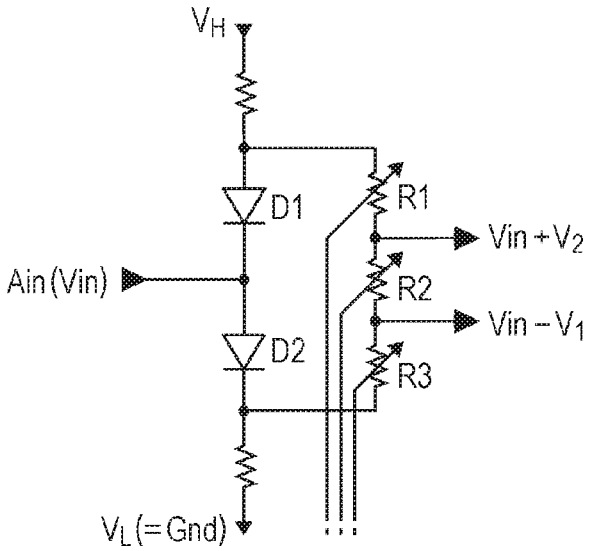
FIG. 15 is a diagram illustrating another example of a first offset unit and a second offset unit.

FIG. 15 is a diagram illustrating a configuration example (another example of a first offset unit and a second offset unit) for obtaining the voltages ($Vin+V_2$) and ($Vin-V_1$) which are obtained by offsetting the voltage Vin in a vertical direction.

In this example, the voltages ($Vin-V_1$) and ($Vin+V_2$) can be obtained by dividing voltages from a voltage which is obtained by offsetting the voltage Vin in a high side by a forward voltage of the diode D1, to a voltage which is obtained by offsetting the voltage Vin in a low side by a forward voltage of the diode D2, using variable resistors R1, R2, and R3. Here, a configuration is used in which the voltage setting unit 250 switches the resistance values of the variable resistors R1, R2, and R3, and thereby the voltages $V_1$ and $V_2$ are indirectly set.

In the embodiment, the transistors 231 and 232 are described as switching elements which are turned on or off, but the invention is not limited to this. For example, a configuration may be provided in which a drain current (resistance between source and drain) is changed in accordance with a voltage between a gate and a source. That is, a configuration may be provided in which the transistor 231 (232) is controlled by the signal Gt1 (Gt2).

In addition, in the embodiment, the drive circuit 120*a* has a configuration in which the comparator 221 discriminates whether the voltage Out is higher than or equal to the voltage ($Vin-V_1$) or lower than the voltage ($Vin-V_1$).

That is, a configuration is used in which the comparator 221 discriminates whether Out $Vin-V_1$ or $Out<Vin-V_1$.

Here, the inequality can be changed to $Out+V_1 \geq Vin$ or $Out+V_1<Vin$, and thus the comparator 221 may discriminate whether the voltage ($Out+V_1$) is higher than or equal to the voltage Vin or lower than the voltage Vin.

In addition, here, the inequality can also be changed to, for example, $Out+V_1/2$ $Vin-V_1/2$, or $Out+V_1/2<Vin-V_1/2$.

For this reason, the comparator 221 may discriminate whether the voltage ($Out+V_1/2$) is higher than or equal to the voltage ($Vin-V_1/2$) or lower than the voltage ($Vin-V_1/2$).

The point is that a configuration may be provided in which the comparator 221 level-shifts at least one of the voltage Vin which is an input signal and the voltage Out which is a drive signal of an output, and compares the voltages in which the other voltage is offset with respect to one voltage by the voltage $V_1$.

In the same manner, a configuration is used in which the comparator 222 discriminates whether $Out \geq Vin+V_2$ or $Out<Vin+V_2$.

Here, the inequality can be changed to $Out-V_2 \geq Vin$ or $Out-V_2<Vin$, and thus the comparator 222 may discriminate whether the voltage ($Out-V_2$) is higher than or equal to the voltage Vin or lower than the voltage Vin.

In addition, the inequality can also be changed to, for example, $Out-V_2/2$ $Vin+V_2/2$, or $Out-V_2/2<Vin+V_2/2$.

For this reason, the comparator 222 may discriminate whether the voltage ($Out-V_2/2$) is higher than or equal to the voltage ($Vin+V_2/2$) or lower than the voltage ($Vin+V_2/2$).

The point is that a configuration may be provided in which the comparator 222 level-shifts at least one of the voltage Vin which is an input signal and the voltage Out which is a drive signal of an output, and compares the voltages in which the other voltage is offset with respect to one voltage by the voltage $V_2$.

In the embodiment, the voltage setting unit 250 decreases the voltage $V_1$ ($V_2$) in the flat section and increases the voltage $V_1$ ($V_2$) in the change section, with respect to the reference power supply 211 (212), and instructs switching at the second stage, but may instruct switching at stages higher than or equal to the third stage. For example, the voltage setting unit 250 makes the dead bandwidth narrower as the slope of the trapezoidal waveform decreases, and may instruct setting of the voltage $V_1$ ($V_2$) according to the reference power supply 211 (212) such that the dead bandwidth becomes minimum in slope zero (flat section). In addition, the voltage setting unit 250 may instruct the voltage $V_1$ ($V_2$) without stage.

In the embodiment, the voltage setting unit 250 instruct the reference power supplies 211 and 212 to switch voltages at the same time, but may instruct any one in accordance with section transition of the trapezoidal waveform.

That is, in the drive circuit 120*a*, when the voltage Vin rises, rising of the voltage Out is controlled by ON and OFF of the transistor 231 which is performed by the comparator 221, and ON and OFF of the transistor 232 which is performed by the comparator 222 is irrelevant. For this reason, a configuration may be provided in which, when the voltage Vin is transitioned from the flat section to the change section of rising, the voltage setting unit 250 instructs the reference power supply 211 to switch the low voltage $V_1$ to the high voltage $V_1$, and does not instruct the reference power supply 212 such that the voltage $V_2$ is maintained as it is.

In contrast to this, when the voltage Vin falls, falling of the voltage Out is just controlled by ON and OFF of the transistor 232 which is performed by the comparator 222, and ON and OFF of the transistor 231 which is performed by the comparator 221 is irrelevant. For this reason, a configuration may be provided in which, when the voltage Vin is transitioned from the flat section to the change section of falling, the voltage setting unit 250 instructs the reference power supply 212 to switch the low voltage $V_1$ to the high voltage $V_1$, and does not instruct the reference power supply 211 such that the voltage $V_1$ is maintained as it is.

In the embodiment, a configuration is used in which the drive circuit 120*a* (120*b*) amplifies a signal (original drive signal) which is converted by the DAC 113*a* (113*b*), using the voltage amplifier 115*a* (115*b*), and receives amplified signal as a signal Ain (Bin), but decreases the drive signal COM-A (COM-B) which is an output to a predetermined reduction ratio and feeds back to the comparators 221 and 222. Meanwhile, if two transistors which are coupled in series between the power supply voltages according to the output voltage are controlled based on a signal which is obtained by level-shifting outputs of the comparators 221 and 222, the original drive signal and the reduced drive signal can be directly compared with each other, and thus a voltage amplifier is not required.

In the embodiment, a liquid ejecting apparatus is described as a printing apparatus, but the liquid ejecting apparatus may be a three-dimensional shaping apparatus which shapes a three-dimensional image by ejecting liquid, a textile dyeing apparatus which dyes textile by ejecting liquid, or the like.

In addition, in the embodiment, an example in which the piezoelectric element Pzt which ejects ink is used as a drive target of the drive circuit 120*a* (120*b*) is described, but when it is considered that the drive circuit 120*a* is separated from the printing apparatus, the drive target is not limited to the piezoelectric element Pzt, and can be applied to, for example, an ultrasonic motor, a touch panel, an electrostatic speaker, or all of the load having a capacitive component such as a liquid crystal panel.

What is claimed is:

1. A liquid ejecting apparatus comprising:

an ejecting unit that includes a piezoelectric element which is displaced by a drive signal that is applied, and ejects liquid in accordance with displacement of the piezoelectric element;

a comparison unit that includes a first comparator and a second comparator, receives an input signal and the drive signal, and outputs a first control signal and a second control signal; and a pair of transistors that is configured by a first transistor which is controlled based on the first control signal and a second transistor which is controlled based on the second control signal, and outputs the drive signal, wherein the first comparator compares a first comparison signal and a second comparison signal with each other, and outputs the first control signal, wherein the first comparison signal is a signal that is obtained by offsetting one of the input signal and the drive signal by a first voltage, wherein the second comparator compares a third comparison signal and a fourth comparison signal with each other, and outputs the second control signal, wherein the third comparison signal is a signal that is obtained by offsetting one of the input signal and the drive signal by a second voltage, and wherein the first voltage and the second voltage are variable.

2. The liquid ejecting apparatus according to claim 1, wherein the second comparison signal is a signal that is obtained by offsetting the other of the input signal and the drive signal by a voltage including zero volts, and wherein the fourth comparison signal is a signal that is obtained by offsetting the other of the input signal and the drive signal by a voltage including zero volts.

3. The liquid ejecting apparatus according to claim 1, wherein the first voltage changes in a first section and a second section of the drive signal.

4. The liquid ejecting apparatus according to claim 3, wherein, if the amount of voltage change of the drive signal in the first section is less than the amount of voltage change of the drive signal in the second section, a first voltage in the first section is lower than a first voltage in the second section in terms of an absolute value.

5. The liquid ejecting apparatus according to claim 4, wherein the first section is a section in which the amount of voltage change of the drive signal is zero.

6. The liquid ejecting apparatus according to claim 1, further comprising:

a first offset unit which decreases the input signal by the first voltage or increases the drive signal by the first voltage; and a second offset unit which increases the input signal by the second voltage or decreases the drive signal by the second voltage.

7. The liquid ejecting apparatus according to claim 1, wherein the first comparator sets the first control signal as a signal that turns on the first transistor, if a voltage of the drive signal is lower than a voltage that is obtained by subtracting the first voltage from a voltage of the input signal, and wherein the second comparator sets the second control signal as a signal that turns on the second transistor, if a voltage of the drive signal is higher than or equal to a voltage that is obtained by adding the second voltage to a voltage of the input signal.

8. The liquid ejecting apparatus according to claim 1, wherein the input signal is a signal that is obtained by amplifying an original drive signal which is a base of the drive signal.

9. A liquid ejecting apparatus comprising:

an ejecting unit that includes a piezoelectric element which is displaced by a drive signal that is applied, and ejects liquid in accordance with displacement of the piezoelectric element;

a comparison unit that includes a first comparator and a second comparator, receives an input signal and the drive signal, and outputs a first control signal and a second control signal; and a pair of transistors that is configured by a first transistor which is controlled based on the first control signal and a second transistor which is controlled based on the second control signal, and outputs the drive signal, wherein the first comparator compares a first comparison signal and a second comparison signal with each other, and outputs the first control signal, wherein the first comparison signal is a signal that is obtained by offsetting one of the input signal and the drive signal by a first voltage, wherein the second comparator compares a third comparison signal and a fourth comparison signal with each other, and outputs the second control signal, wherein the third comparison signal is a signal that is obtained by offsetting one of the input signal and the drive signal by a second voltage, wherein the first voltage and the second voltage are variable, wherein the first comparison signal is lower than the input signal, and wherein the third comparison signal is higher than the input signal.

10. A drive circuit, which drives a capacitive load in accordance with a drive signal, comprising:

a comparison unit that includes a first comparator and a second comparator, receives an input signal and the drive signal, and outputs a first control signal and a second control signal; and a pair of transistors that is configured by a first transistor which is controlled based on the first control signal and a second transistor which is controlled based on the second control signal, and outputs the drive signal, wherein the first comparator compares a first comparison signal and a second comparison signal with each other, and outputs the first control signal, wherein the first comparison signal is a signal that is obtained by offsetting one of the input signal and the drive signal by a first voltage, wherein the second comparator compares a third comparison signal and a fourth comparison signal with each other, and outputs the second control signal, wherein the third comparison signal is a signal that is obtained by offsetting one of the input signal and the drive signal by a second voltage, and wherein the first voltage and the second voltage are variable.

11. A head unit comprising:

an ejecting unit that includes a piezoelectric element which is displaced by a drive signal that is applied, and ejects liquid in accordance with displacement of the piezoelectric element, wherein the ejecting unit of the head unit includes a comparison unit that includes a first comparator and a second comparator, receives an input signal and the drive signal, and outputs a first control signal and a second control signal; and a pair of transistors that is configured by a first transistor which is controlled based on the first control signal and a second transistor which is controlled based on the second control signal, and outputs the drive signal, wherein the first comparator compares a first comparison signal and a second comparison signal with each other, and outputs the first control signal, wherein the first comparison signal is a signal that is obtained by offsetting one of the input signal and the drive signal by a first voltage, wherein the second comparator compares a third comparison signal and a fourth comparison signal with each other, and outputs the second control signal, wherein the third comparison signal is a signal that is obtained by offsetting one of the input signal and the drive signal by a second voltage, and wherein the first voltage and the second voltage are variable, and wherein the head unit is driven by a drive circuit.

* * * * *